United States Patent [19]

Danley et al.

[11] Patent Number: 4,477,705

[45] Date of Patent: Oct. 16, 1984

[54] MICROWAVE OVEN POPCORN POPPER, STEAMER AND ROASTER

[75] Inventors: Allen M. Danley, Eagan; Mark L. Steingraber, St. Paul, both of Minn.

[73] Assignee: Plastics, Inc., St. Paul, Minn.

[21] Appl. No.: 383,695

[22] Filed: Jun. 1, 1982

[51] Int. Cl.[3] ..... H05B 6/80; A23L 1/18

[52] U.S. Cl. ..... 219/10.55 E; 219/10.55 F; 99/323.5; 99/340; 99/451; 99/DIG. 14

[58] Field of Search ..... 219/10.55 E, 10.55 R, 219/10.55 F; 99/323.5, 323.6, 323.7, 323.8, 323.9, 323.11, 340, DIG. 14, 451

[56] References Cited

U.S. PATENT DOCUMENTS

| | | | |
|---|---|---|---|
| 2.078,719 | 4/1937 | Roach | 53/4 |
| 2,113,091 | 4/1938 | Mills | 53/4 |
| 2,123,663 | 7/1938 | Roach | 53/4 |
| 2,480,679 | 8/1949 | Spencer | 99/100 |
| 2,522,085 | 9/1950 | Beckemeyer et al. | 219/19 |
| 2,602,134 | 7/1952 | Nelson | 219/47 |
| 2,901,587 | 8/1959 | Burreson | 219/44 |
| 2,939,379 | 6/1960 | Schmitt | 99/238.4 |
| 3,079,854 | 3/1963 | Sheperd | 99/238.1 |
| 3,232,214 | 2/1966 | Aske | 99/340 |
| 3,457,852 | 7/1969 | Kwoh | 99/340 |
| 3,611,910 | 10/1971 | Hughes | 99/323.5 |
| 3,699,874 | 10/1972 | Dusek | 99/238.1 |
| 3,722,399 | 3/1973 | Cole | 99/323.8 |
| 3,773,669 | 11/1973 | Yamauchi et al. | 252/62.58 |
| 3,835,280 | 9/1974 | Gades et al. | 219/10.55 |
| 3,847,067 | 11/1974 | Munsey | 99/323.8 |
| 3,974,354 | 8/1976 | Long | 219/10.55 |
| 4,013,798 | 3/1977 | Goltsos | 426/107 |
| 4,038,425 | 7/1977 | Brandberg et al. | 426/107 |
| 4,156,806 | 5/1979 | Teich et al. | 219/10.55 |
| 4,158,760 | 6/1979 | Bowen et al. | 219/10.55 |
| 4,166,208 | 8/1979 | Martel et al. | 219/10.55 |
| 4,299,160 | 11/1981 | Wokeck | 219/10.55 G X |
| 4,332,188 | 6/1982 | Rhear | 99/323.5 |
| 4,335,291 | 6/1982 | Ishino et al. | 219/10.55 E |

FOREIGN PATENT DOCUMENTS 2421216 11/1975 Fed. Rep. of Germany .

OTHER PUBLICATIONS

Marketing Brochure, "Micro Chef" Microwave Oven Cookware by Bangor Plastics, Inc., Jan. 1980.

Marketing Brochure Microwave Cookware by Regal Ware Inc., Jul. 1981.

*Primary Examiner*—P. H. Leung

*Attorney, Agent, or Firm*—Price, Heneveld, Huizenga & Cooper

[57] ABSTRACT

A cooking utensil for a microwave oven is provided comprising a shallow, generally hollow, lower cooking member defining a pyramidal-shaped cavity with an open base. A stand orients the lower cooking member in the microwave oven cavity with the open base upwardly directed to define an open top, pyramidal-shaped lower heating chamber for retaining and heating popcorn kernels. Unpopped popcorn kernels are gravity biased into the apexes defined by the intersections of the sidewalls of the pyramidal-shaped heating chamber to facilitate efficient heating of the unpopped kernels. A cover is disposed over the lower cooking member comprising a deep, generally hollow, upper member defining a roughly cube-shaped cavity with one open side. A support is provided for orienting the open side of the cover relative to the lower cooking member such that the open side of the roughly cube-shaped cavity communicates with the open top of the pyramidal-shaped lower heating chamber to define an upper chamber for receiving and storing popped popcorn kernels upwardly and away from the heating chamber to prevent scorching of the popped kernels. A steaming and roasting trivet is provided which engages a lower cooking member and defines a generally horizontal surface for supporting foodstuffs above the lower heating chamber. The trivet converts the cooking utensil into a steaming and roasting device wherein the lower heating chamber retains liquid and the upper chamber comprises an oven chamber.

27 Claims, 12 Drawing Figures

MICROWAVE OVEN POPCORN POPPER, STEAMER AND ROASTER

BACKGROUND OF THE INVENTION

The invention relates generally to the cooking of foodstuffs in a microwave oven. More particularly, a multi-purpose microwave oven cooking device is provided which is capable of popping corn, steaming, and roasting.

Popcorn has been made in many ways. For example, the kernels have been placed in a screen-like container, with a long handle such that the corn may be held suspended above an open flame or coals. In other cases, the corn is popped with hot oil that is heated in a variety of fashions, or is suspended in a fluidized bed and popped with hot air. Whatever the arrangement for heating the corn, in many cases, a container is provided which contains a large upper portion and a relatively small lower portion. The smaller, lower portion is used to retain the kernels in a clumped mass for heating and the larger, upper portion is used as a storage area for popped kernels to expand into. With many of these prior art methods of popping corn, radiant, conductive or convective heat was not distributed evenly and agitation of the popcorn popper was necessary to promote a more uniform distribution of heat to the unpopped kernels.

More recently, an interest has developed in popping corn with microwave energy. This has an advantage in that agitation is usually not necessary since microwave energy will easily contact each unpopped kernel. In one prior art method, a sealed and sometimes partially collapsed plastic bag of kernels, with or without oil, is placed in a microwave oven. Microwave radiation is then directed into the oven to the kernels, causing them to pop and expand into the bag. In another case, a relatively deep conically-shaped bowl is provided which is transparent to microwave energy. The conically-shaped bowl is oriented in the oven with a downwardly directed apex which acts as a heating chamber for retaining unpopped kernels in a clumped mass while the upper portion of the bowl provides an upper storage chamber within which the popped corn kernels can expand. Methods that involve popping corn with disposable plastic containers are inevitably more costly because of the disposal of the container. However, the prior art conically-shaped microwave oven reuseable popcorn poppers suffer from a limitation in the quantity of popcorn which can be produced in any given batch.

Steaming and roasting of vegetables, meat, poultry and fish with microwave energy has also become more popular in recent years. Generally, these operations are carried out in conventionally-shaped bowls or containers with a removable cover. Often the use of conventionally-shaped cooking utensils of this type for steaming and roasting in a microwave oven does not result in the most efficient distribution of microwave energy or the heat and steam resulting from absorption of microwave energy by the foodstuffs.

SUMMARY OF THE INVENTION

According to the present invention, these and other problems in the prior art are solved by provision of a cooking utensil for cooking foodstuffs in a microwave oven cavity oomprising a shallow, generally hollow, lower cooking member defining a pyramidal-shaped cavity with an open base. A stand is provided for orienting the lower cooking member in a microwave oven cavity with the open base upwardly directed to define an open top pyramidal-shaped lower heating chamber for retaining and heating unpopped corn kernels when the device is used as a popcorn popper. The corners or the apexes defined by the intersections of the sidewalls of the pyramidal-shaped heating chamber, provide areas of concentrated heating. The unpopped corn kernels are gravity biased into the apexes defined by the intersections of the sidewalls of the pyramidal-shaped heating chamber to provide for efficient heating of the unpopped corn kernels. A support is provided for mounting a cover about the periphery of the lower cooking member. The cover comprises a deep, generally hollow, upper member defining a roughly cube-shaped cavity with one open side. The support orients the cover relative to the lower cooking member such that the open side of the roughly cube-shaped cavity communicates with the open top of the pyramidal-shaped lower heating chamber to define an upper chamber for receiving and storing popped corn kernels upwardly and away from the heating chamber to prevent scorching of the corn kernels when the device is used as a popcorn popper. A steaming and roasting trivet is provided which engages the lower cooking member and defines a generally horizontal surface for supporting foodstuffs above the lower heating chamber when the device is used as a steamer or roaster. The trivet converts the cooking utensil into a steaming or roasting device wherein the lower heating chamber is used to retain liquid and the upper chamber is used as an oven chamber.

DESCRIPTION OF THE PREFERRED EMBODIMENTS

Figure 1:
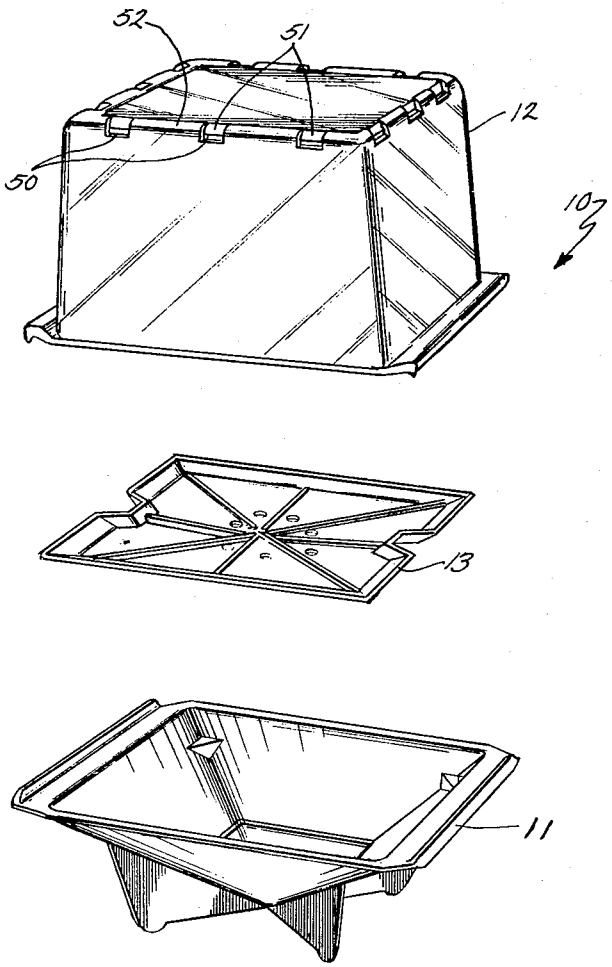
FIG. 1 is a perspective view of the cooking utensil of the present invention.
Figure 2:
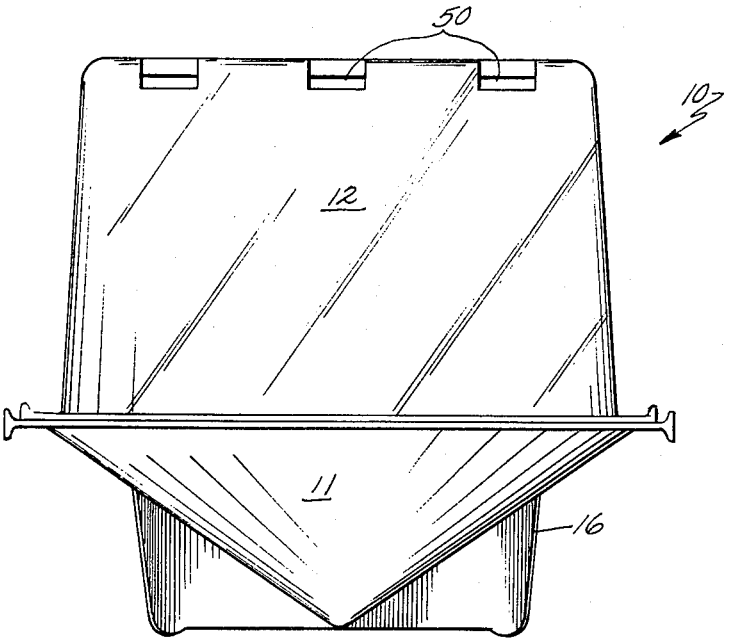
FIG. 2 is a side elevational view of the cooking utensil of the present invention.

With reference now to FIGS. 1 and 2, the cooking utensil of the present invention is illustrated at 10. As best illustrated in FIG. 1, the cooking utensil comprises three basic components, a shallow, generally hollow, lower cooking member 11, a cover 12 and a steaming or roasting trivet 13. The lower cooking member 11 and the cover 12 are used for popping corn. When the trivet 13 is added, the device is converted into a steaming or roasting utensil.

Figure 3:
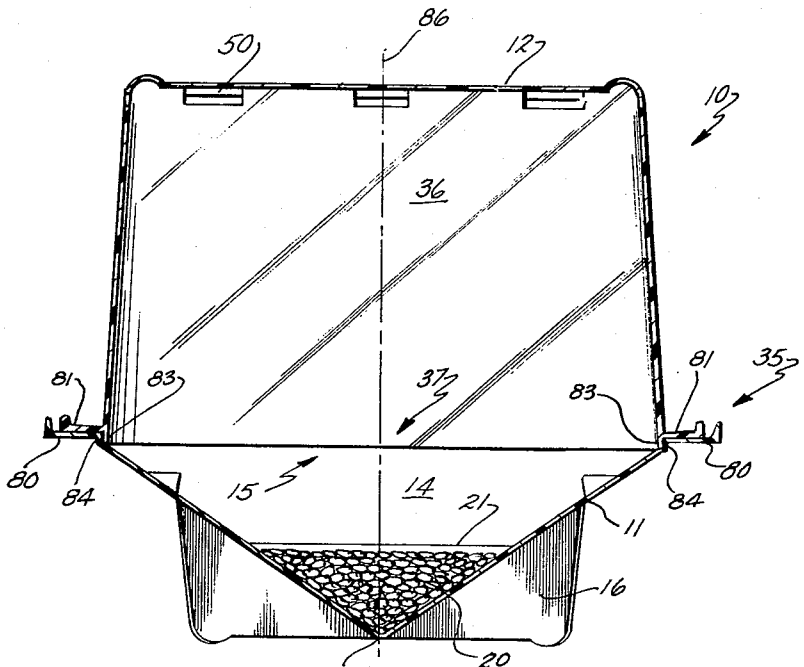
FIG. 3 is an elevational view in section, of the cooking utensil of the present invention, with the cooking utensil in the configuration of a popcorn popper.

With reference now also to FIG. 3, the cooking utensil 10 is illustrated in a configuration used for popping corn in a microwave oven cavity. The popcorn popping device comprises a shallow, generally hollow, lower cooking member 11 which defines a pyramidal-shaped cavity 14, best illustrated in FIG. 4. What would normally be considered the base surface 15 of the pyramidal-shaped cavity is open. A stand 16 is provided for orienting the lower cooking member 11 in a microwave oven cavity such that the open base 15 is upwardly directed for defining an open top pyramidal-shaped lower heating chamber at 14. The lower heating chamber 14 retains and heats unpopped corn kernels that are disposed at 20. A line is provided at 21 for measuring out an appropriate amount of corn when initially filling the device. As illustrated in FIG. 3, the unpopped kernels are initially gravity biased into the apex 25 defined by the intersection of the four sidewalls 26, 27, 28 and 29 of the pyramidal-shaped cavity 14. This groups the unpopped corn in a clumped mass for initial heating in the microwave oven cavity. Once a sufficient amount of heat is added and some of the kernels begin to pop, many of the unpopped kernels are strewn about within the cooking utensil 10. Thereafter, the unpopped kernels that are strewn about are also gravity biased into the apexes defined by the intersections of adjacent sidewalls of the pyramidal-shaped heating chamber, as best illustrated in FIG. 5. The star-shape distribution of unpopped kernels 30 that results from this process has been found to provide more efficient heating of the unpopped kernels by microwave energy than the prior art clumped mass technique. This observation is believed to be due to the fact that cooking utensils having sharp corners provide for concentrated heating in the corners of the utensil. For example, if the pyramidal-shaped cavity 14 were filled with a dough or batter and irradiated in a microwave oven, a substantial increase in the cooking rate of the dough or batter would be observed in the corners of the utensil. This heat concentrating effect is extremely useful when the device is used as a popcorn popper since the shape of the cavity, the agitation of the unpopped kernels by popping kernels, and the effect of gravity automatically biases the unpopped kernels into corners of the heating chamber where they are most efficiently heated.

A support is provided at 35 for supporting the cover 12 about the periphery of the lower cooking member 11. The cover 12 comprises a deep, generally hollow, upper member defining a roughly cube-shaped cavity 36 with one open side 37. The cover 12 is illustrated in further detail in FIG. 6. As best illustrated in FIG. 3, the support 35 orients the cover 12 relative to the lower cooking member 11 such that the open side 37 of the roughly cube-shaped cavity 36 communicates with the open top of of the pyramidal-shaped lower heating chamber 14 to define an upper chamber at 36 for receiving and storing popped corn kernels upwardly and away from the heating chamber 14 such that scorching of the popped kernels is substantially reduced. When substantially all of the unpopped corn disposed in the lower cooking member 11 has popped, the utensil may be removed from the microwave oven and inverted. Once the lower cooking member 11 is removed, the cover 12 provides a serving bowl.

Figure 8:
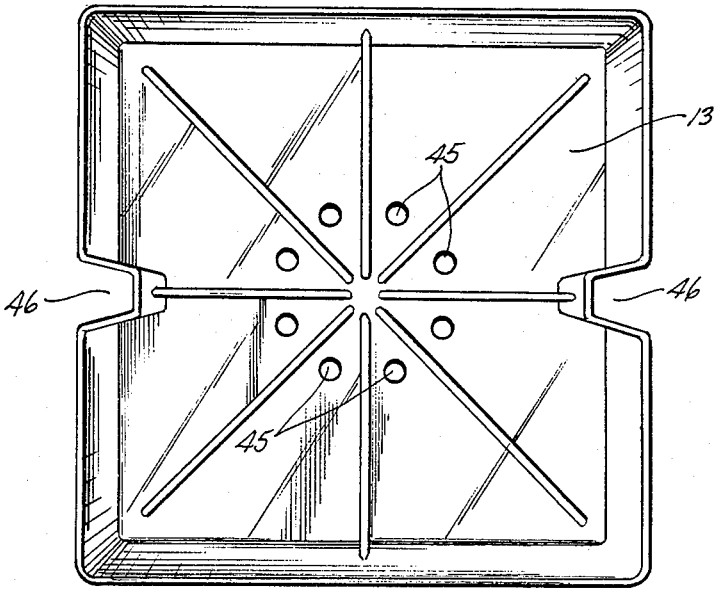
FIG. 8 is a top view of the trivet of the cooking utensil of the present invention.
Figure 7:
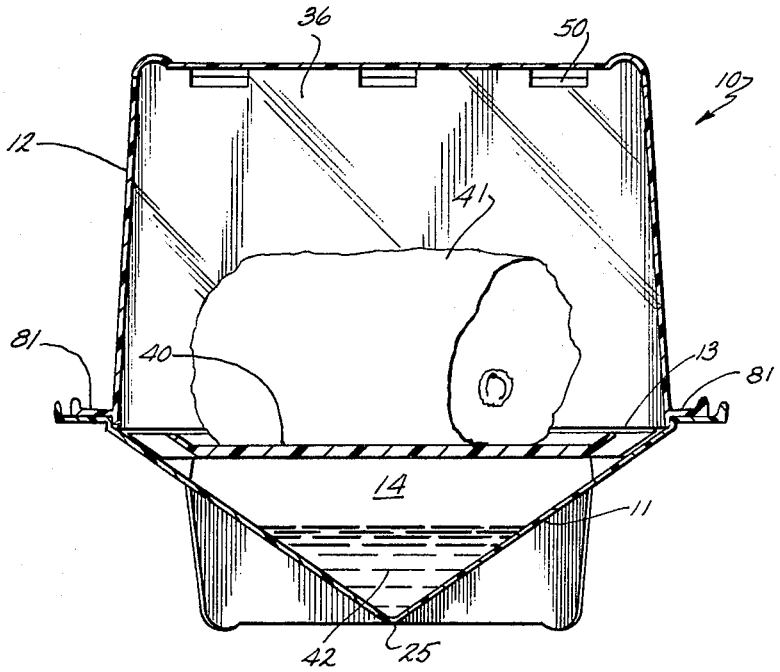
FIG. 7 is an elevational view taken in section, of the cooking utensil of the present invention, configured for a roasting or steaming operation.
Figure 10:
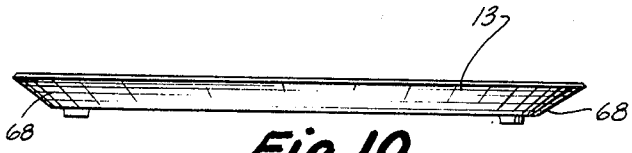
FIG. 10 is a side view of the trivet.
Figure 9:
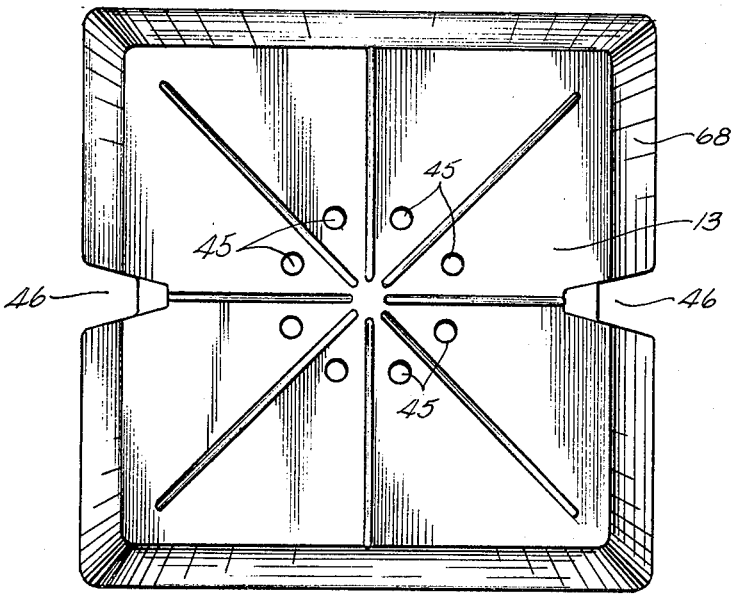
FIG. 9 is a bottom view of the trivet.

With reference now to FIG. 7, the cooking utensil 10 is illustrated in a configuration that is used for steaming and roasting. The steaming and roasting trivet 13 engages the lower cooking member 11 and defines a generally horizontal surface 40 for supporting foodstuffs at 41 above the lower heating chamber 14. The trivet 13 converts the cooking utensil into a steaming and roasting device by dividing the cooking utensil into a lower heating chamber 14 for retaining liquid and an upper heating chamber 36 which acts as an oven chamber. In the case where the device is used as a roasting device, juice is expressed from the meat, poultry or fish which is being roasted on the trivet 13 and is collected at 42 in the apex 25 of the pyramidal-shaped heating chamber 14. In the case where vegetables or the like are to be steamed in the device, the vegetables are clumped on the horizontal surface 40 of the trivet 13 and a few ounces of water are disposed at 42 in the apex 25 of the pyramidal-shaped lower heating chamber 14. The trivet, which is illustrated in further detail in FIGS. 8, 9 and 10, includes a plurality of apertures or vents 45 which facilitate the passage of juices expressed from roasted meats into the lower heating chamber 14 during a roasting process and which facilitate the passage of steam from the lower heating chamber into the upper oven chamber 36 during a steaming operation. The apertures 46 serve a similar function as well as providing fingerholds for removing and remounting the trivet within the chamber 14.

In a cooking device having general utility as a popcorn popper, steamer and roaster, the lower cooking member, the cover, and the trivet are all formed from low dielectric loss materials. However, in some embodiments of the invention, a trivet may be provided which is formed from a material having a predetermined lossiness which facilitates browning of foodstuffs disposed on the trivet. Preferably, the cover 12 is formed from a transparent material which enables the user to monitor the condition of the foodstuffs being heated within the cooking device.

The cover 12 contains a plurality of vents 50 having a predetermined cross-sectional area that permits a controlled amount of steam and other expanding gases to be vented to the atmosphere. The vents 50 are preferably formed in the sides of the cover 12 to permit the use of the cover 12 as a serving bowl for popcorn or the like without significant loss of the popcorn or any seasoning placed thereon through the vents. As perhaps best illustrated in FIG. 1, the vents 50 are disposed in channels 51 which wrap around the top edge 52 of the cover 12. The vents 50 are disposed at the bottom of the channels 51 facing downwardly to facilitate tooling of the molds which are used to form the cover 12.

Figure 11:
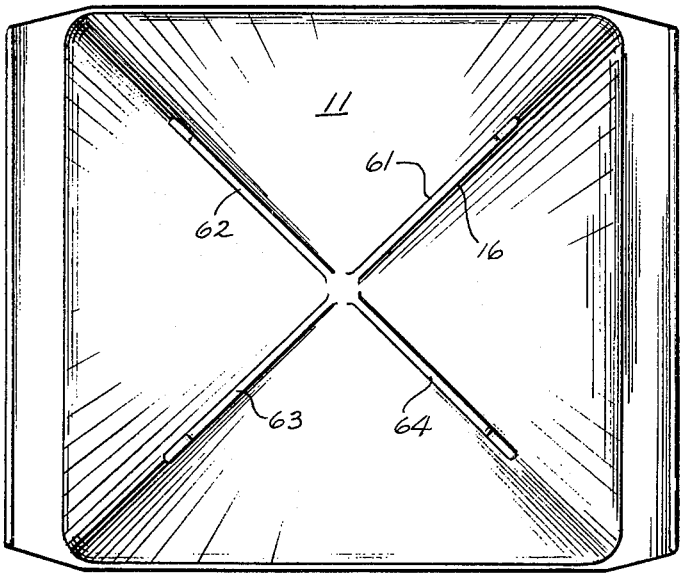
FIG. 11 is a bottom view of the lower cooking member of the cooking utensil of the present invention.

With particular reference to FIGS. 2 and 11, the stand 16 disposed on the lower cooking member 11 is illustrated in further detail. Preferably, the lower cooking member 11 and the stand 16 are integrally formed in a single molding process and the stand 16 comprises a plurality of legs 61 through 64 which project outwardly and downwardly from the underside of the lower cooking member 11. In preferred embodiments, the legs 61 through 64 extend from the apexes defined by the intersections of the sidewalls of the lower cooking member 11.

With reference now again to FIGS. 4, 8, 9 and 10, it is illustrated that in preferred embodiments, the trivet 13 is generally rectangular in shape and is provided with a bevelled edge 68, best illustrated in FIG. 10, for engaging the sloping sidewalls of the pyramidal-shaped lower heating chamber 14. The pyramidal-shaped heating chamber 14 includes a plurality of gussets 71 through 74 which engage the underside of the trivet 13 to further stablize the trivet 13 within the pyramidal-shaped lower heating chamber 14.

Figure 4:
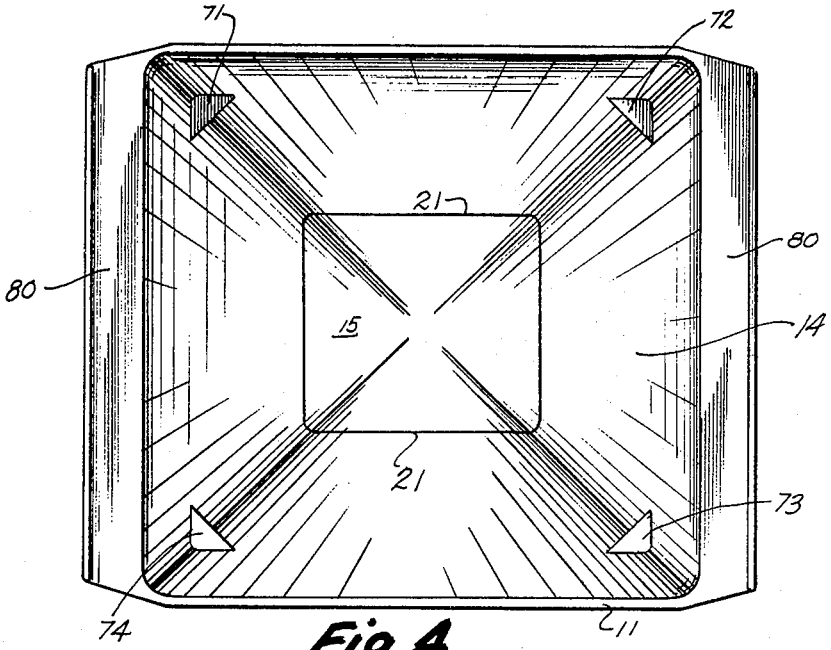
FIG. 4 is a top view of the lower cooking member of the cooking utensil of the present invention.
Figure 5:
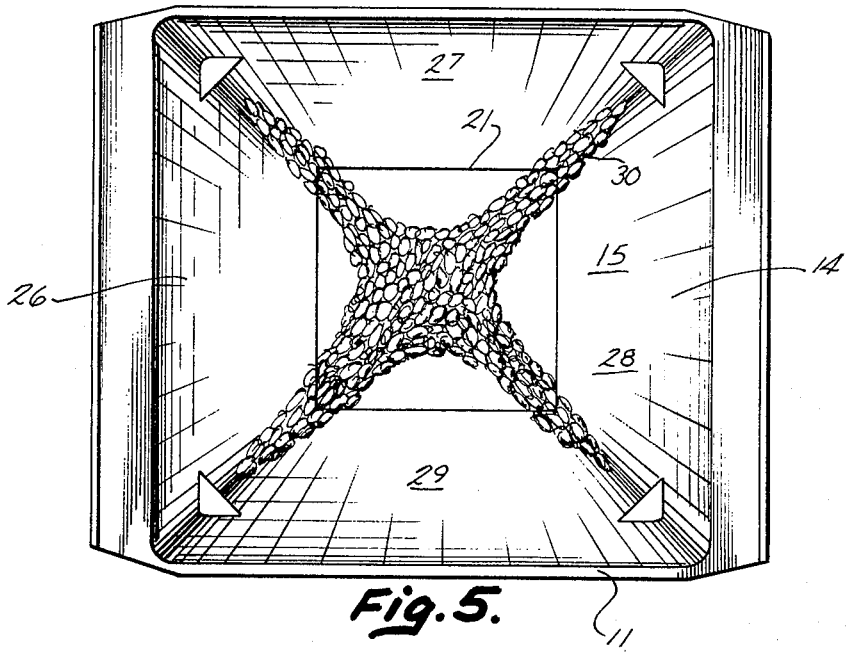
FIG. 5 is a top view of the lower cooking member of the cooking utensil with unpopped popcorn kernels distributed therein.
Figure 6:
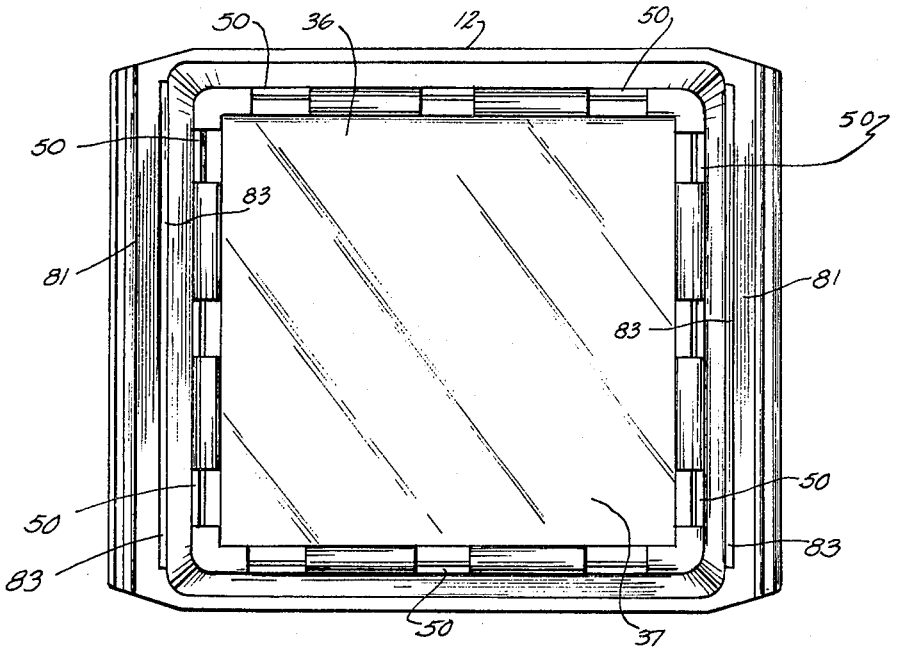
FIG. 6 is a top view of the cover of the cooking utensil of the present invention.

With particular reference now to FIGS. 3 and 4, it is illustrated that the support means 35 for orienting the cover 12 relative to the lower cooking member 11 comprises a first generally horizontal flange 80 disposed about the periphery of the lower cooking member 11. With reference now also to FIG. 6, it is further illustrated that the support means also includes a second generally horizontal flange 81 which is disposed about the periphery of the cover 12. The cover 12 is supported above the lower cooking member 11 through engagement of the first and second flanges 80 and 81, as best illustrated in FIG. 3. The support means 35 also comprises a third generally vertical flange 83 disposed on the periphery of the cover 12 and a shoulder 84 disposed on the lower cooking member 11 for properly orienting the cover 12 relative to the central vertical axis 86 of the cooking device.

Figure 12:
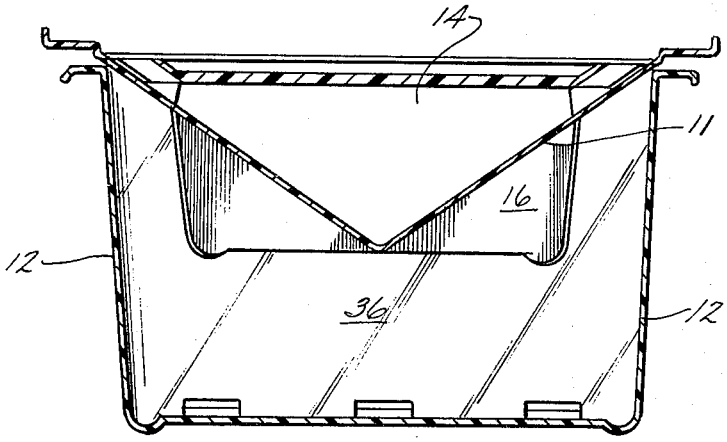
FIG. 12 is an elevational view taken in section of the cooking utensil of the present invention, when configured for storage.

With reference now to FIG. 12, it is illustrated that the lower cooking member 11 and the stand 16, are provided with dimensions which facilitate insertion of the stand 16 and the pyramidal-shaped heating chamber 14 within the cavity 36 of the inverted cover 12 in a nested-like fashion for efficient storage.

OPERATION

With reference to FIG. 3, popcorn is prepared in the cooking utensil 10 of the present invention by pouring popcorn into the pyramidal-shaped lower heating chamber 14. Popcorn is added at 20 until the level of the popcorn is approximately equal to the level line 21 (approximately ½ cup). Thereafter, the cover 12 is set upon the lower cooking member 11 by arranging the first and second flanges 80 and 81 in an overlapping fashion as illustrated in FIG. 3. The cooking utensil 10 is then placed in a microwave oven cavity and the oven is turned on high (100%) heat for three to five minutes. In some cases, the cooking time may be increased as needed to increase the yield of popped corn. However, the oven should be turned off as soon as the popcorn has audibly or visually stopped popping. Prolonged cooking will not increase yield, but can eventually char the popcorn. The cooking device is then inverted and the lower cooking member 11 is removed from the cover 12 so that the cover 12 may be used as a serving bowl. Seasoning and melted butter may thereafter be added to suit the individual taste of the user. If the user prefers, oil may also be used with the utensil. In the case where oil is desired, two tablespoons of oil should be added to the pyramidal-shaped lower cooking chamber 14 and preheated for two minutes on high (100%) heat in the microwave oven cavity before the popcorn is added to the lower cooking chamber.

With reference now to FIG. 7, a typical steaming operation will be described. For example, when steaming fresh broccoli or other similar fresh vegetables, approximately one-half cup of water is added to the lower heating chamber 14 of the lower cooking member 11, as indicated at 42. The trivet 13 is then added to the lower cooking member 11, and an appropriate amount of the fresh vegetable (in the case of broccoli, approximately eight ounces) is disposed on the horizontal surface 40. After the cover 12 is mounted in the manner previously described, the steamer is placed within a microwave oven and the vegetables are irradiated according to recipe instructions. In the case of broccoli, typically four to five minutes on high (100%) heat is necessary. The device should be left standing for two to three minutes thereafter before the cover 12 is removed. In the steaming operation, microwave energy heats the water disposed at 42 in the chamber 14 and steam rises from the chamber 14 through the vents 45 and the finger holes 46, best illustrated in FIG. 8, to encircle the vegetables disposed within the upper heating chamber or oven chamber 36 to affect the efficient steaming thereof. Frozen vegetables may be cooked in a similar manner by heating on high (100%) heat for six to eight minutes and corn on the cob may be prepared in a similar fashion by heating on high (100%) heat for seven to eight minutes and allowing the corn to stand for three to five minutes thereafter. Meat products, such as hot dogs and bratwurst may also be effectively steamed in the cooking utensil of the present invention.

With reference again to FIG. 7, to operate the cooking utensil 10 of the present invention as a roasting device, the trivet 13 is inserted in the lower cooking member 11 and the meat product 41, which is to be roasted, is disposed on the horizontal surface 40. Thereafter, the cover 12 is disposed on the lower cooking member 11 in the manner previously described and the roaster is placed in a microwave oven and cooked according to recipe instructions. After an appropriate cooking and standing time, the cooking utensil may be removed from the oven and the meat served therefrom. For example, a two and one half to three pound boneless beef rump, or bottom round roast, may be cooked with the device by placing the meat, fat side down, on the trivet 13, adding the desired seasoning and inserting a microwave heat thermometer. The cover is then disposed on the lower cooking member 11 and the device is irradiated in a microwave oven cavity on medium (50%) heat for approximately 10 minutes, then the meat is turned fat side up, recovered and microwave oven cooking is continued on medium (50%) heat for ten to fifteen minutes or until the internal temperature of the meat registers approximately 120° F. Thereafter, the meat should be left to stand covered for approximately ten minutes before slicing and serving. During this roasting process, any juices expressed from the meat are collected at 42 in the apex 25 of the pyramidal-shaped lower heating chamber 14. Two and one half to three pounds of boneless roast pork may be cooked in a similar fashion by placing the meat on the trivet 13, fat side up, and cooking on medium-high (70%) heat for twenty-five to thirty minutes, or until the internal temperature of the meat registers approximately 160° F. Half-way through the cooking time, the meat should be turned over. After the cooking time has expired, the meat should be allowed to stand covered for ten to fifteen minutes, or until the internal temperature registers approximately 170° F., before slicing and serving. In general, other size beef roasts should be allowed approximately ten minutes per pound and other sized pork roasts should be allowed ten to 11 minutes per pound.

Roast chicken may be prepared by placing two to two and one half pounds of whole roasting, or frying chicken preseasoned and brushed with a favorite browning sauce as desired on the trivet 13. The chicken should be placed on the trivet 13 breast side down. Ends of wings and legs should be covered with foil to prevent overcooking. With the cover disposed on the lower cooking member 11, the chicken should be irradiated on high (100%) heat for twelve to fifteen minutes or until tender. The chicken should be turned over half-way through the cooking time and should be left to stand covered for eight to ten minutes before serving. For other sized chickens, six to seven minutes per pound should be allowed. For stuffed chickens, the chicken should be cooked on medium (50%) heat for ten to twelve minutes per pound.

Up to four small to medium-size potatoes may be simultaneously cooked in the device by placing them upon the trivet, covering them and cooking them on high (100%) heat for eight to ten minutes or until tender. Approximately halfway through the cooking time, the potatoes should be turned, and when the cooking time is elapsed, they should be allowed to stand for approximately five minutes after cooking.

Individual meatloaves of approximately the same size may be cooked within the device by placing the meatloaves on the trivet 13 and cooking them on high (100%) heat for nine to ten minutes or until the meat is done. The meat should be allowed to stand for three to four minutes before serving.

The foregoing description of the cooking utensil of the present invention, as well as the foregoing recipes are exemplary and that of the preferred embodiment only. Many modifications of the invention and modifications in its use will become apparent to those who use the device. The present invention encompasses all such modifications of the invention that come within the proper scope of the appended claims.

The embodiments of the invention in which an exclusive property or privilege is claimed are defined as follows:

1. A cooking utensil for popping corn in a microwave oven cavity and serving the popped corn comprising:

a shallow, generally hollow, lower cooking member defining a pyramidal-shaped cavity with an open base;

stand means for orienting said lower cooking member in said microwave oven cavity with said open base being upwardly directed for defining an open top pyramidal-shaped lower heating chamber for retaining and heating unpopped corn kernels, said unpopped corn kernels being gravity biased into apexes defined by the intersections of the sidewalls of said pyramidal-shaped heating chamber whereby efficient heating of said unpopped kernels is facilitated;

a combined cover and serving container;

support means for supporting a combined cover and serving container about the periphery of said lower cooking member;

a handle means for defining a handle disposed at the juncture of said cover and serving container and said lower cooking member;

said cover and serving container comprising a deep, generally hollow, upper member defining a roughly cube-shaped cavity with one open side, said support means orienting said cover and serving container relative to said lower cooking member such that said open side of roughly cube-shaped cavity communicates with said open top of said pyramidal-shaped lower heating chamber to define an upper chamber for receiving and storing popped corn kernels upwardly and away from said heating chamber whereby scorching of said popped kernels is reduced; and vent means disposed in said cover and serving container remote form said handle means for venting said upper chamber to the atmosphere without heating said handle means, said vent means comprises a plurality of apertures, each of the apertures being disposed in a side of said cover and serving container at the terminus of each one of a plurality of channels extending from the side opposite to said open side and down the sides of said cover and serving container to provide for the use of said cover and serving container as a serving container while minimizing the loss of popcorn through said vent means.

2. The cooking utensil of claim 1 further comprising a steaming and roasting trivet for engaging said lower cooking member and defining a generally horizontal surface for supporting foodstuffs above said lower heating chamber, said trivet converting said cooking utensil into a steaming and roasting device wherein said lower heating chamber retains liquid and said upper chamber comprises an oven chamber.

3. The cooking utensil of claim 2 wherein at least one of said lower cooking member, said cover and serving containers and said trivet are formed from a low dielectric loss material.

4. The cooking utensil of claim 2 wherein said trivet is formed from a material having a predetermined lossiness to facilitate browning of foodstuffs disposed on said trivet.

5. The cooking utensil of claim 2 wherein said trivet further includes a plurality of vents interconnecting said lower heating chamber and said upper oven chamber.

6. The cooking utensil of claim 2 wherein said trivet is generally rectangular in shape and engages the sidewalls of said pyramidal-shaped cavity.

7. The cooking utensil of claim 6 wherein said pyramidal-shaped cavity is provided with a plurality of gussets disposed in the apexes defined by the intersections of said sidewalls, said gussets engaging and supporting

8. The cooking utensil of claim 1 wherein said stand comprises a plurality of legs projecting outwardly and downwardly from the underside of said lower cooking member.

9. The cooking utensil of claim 8 wherein said lower cooking member and said stand are molded from a polymeric material, said legs extending from the apexes defined by the intersections of the sidewalls of said lower cooking member.

10. The cooking utensil of claim 1 wherein said cover and serving container is provided with a plurality of vents.

11. The cooking utensil of claim 1 wherein said lower cooking member and said stand means are adapted for insertion into said cover for storage in a nested fashion.

12. The cooking utensil of claim 1 wherein said support means comprises a first generally horizontal flange disposed about the periphery of said lower cooking member.

13. The cooking utensil of claim 12 wherein said support means further comprises a second generally horizontal flange disposed about the periphery of said cover and serving container, said cover and serving container being supported above said lower cooking member through engagement of said first and second flanges.

14. The cooking utensil of claim 13 wherein said support means further comprises a third generally vertical flange disposed on the periphery of said cover and serving container, and a shoulder disposed on the periphery of said lower cooking member said third generally vertical flange engaging said shoulder to provide for the accurate vertical alignment of said lower cooking member and said cover and serving container.

15. The cooking utensil of claim 1 wherein said cover and serving is formed from a transparent material.

16. A cooking utensil for roasting and steaming foodstuffs in a microwave oven cavity comprising:

a shallow generally hollow lower cooking member defining a cavity with an open end;

stand means for orienting said lower cooking member in said microwave oven cavity with said open end upwardly directed for defining an open top lower heating chamber for retaining liquid;

a steaming and roasting trivet for engaging said lower cooking member and defining a generally horizontal surface for supporting foodstuffs above said lower heating chamber; a cover;

support means for supporting said cover about the periphery of said lower cooking member;

said cover comprising a deep, generally hollow upper cooking member with one open side, said support means orienting said cover relative to said lower cooking member such that said open side of said cover communicates with said open top of said lower heating chamber to define an upper oven chamber, said upper oven chamber enclosing foodstuffs disposed on said trivet to provide for the efficient steaming and roasting thereof;

a first vent means for venting said lower heating chamber into said upper oven chamber, said first vent means being disposed at said trivet; and a second vent means disposed on said cover for venting said upper oven chamber, whereby liquids retained in said lower heating chamber are vaporized and circulate upwardly through and around the foodstuffs supported by said trivet under the application of microwave energy, the foodstuffs thus being cooked both by direct absorption of microwave energy and by indirect convective heat transfer from liquids retained in said lower heating chamber, said second vent means comprises a plurality of apertures, each of the apertures being disposed in a side of said cover at the terminus of each one of a plurality of channels extending from the side opposite to said open side and down the sides of said cover.

17. The cooking utensil of claim 16 wherein said cover is formed from a transparent material.

18. The cooking utensil of claim 16 wherein said lower cooking member and said stand means are adapted for insertion into said cover for storage in a nested fashion.

19. The cooking utensil of claim 16 wherein at least one of said lower cooking member, said cover and said trivet are formed from a low dielectric loss material.

20. The cooking utensil of claim 16 wherein said trivet is formed from a material having a predetermined lossiness to facilitate browning of foodstuffs disposed on said trivet.

21. The cooking utensil of claim 16 wherein said trivet is generally rectangular in shape and engages the sidewalls of said pyramidal-shaped cavity.

22. The cooking utensil of claim 21 wherein said pyramidal-shaped cavity is provided with a plurality of gussets disposed in the apexes defined by the intersections of said sidewalls, said gussets engaging and supporting said trivet.

23. The cooking utensil of claim 16 wherein said stand comprises a plurality of legs projecting outwardly and downwardly from the underside of said lower cooking member.

24. The cooking utensil of claim 23 wherein said lower cooking member and said stand are molded from a polymeric material, said legs extending from the apexes defined by the intersections of the sidewalls of said lower cooking member.

25. The cooking utensil of claim 16 wherein said support means comprises a first generally horizontal flange disposed about the periphery of said lower cooking member.

26. The cooking utensil of claim 25 wherein said support means further comprises a second generally horizontal flange disposed about the periphery of said cover, said cover being supported above said lower cooking member through engagement of said first and second flanges.

27. The cooking utensil of claim 26 wherein said support means further comprises a third generally vertical flange disposed on the periphery of said cover, and a shoulder disposed on the periphery of said lower cooking member said third generally vertical flange engaging said shoulder to provide for the accurate vertical alignment of said lower cooking member and said cover.

* * * * *